United States Patent [19]

Smith

[11] 4,167,374

[45] Sep. 11, 1979

[54] PUMP AND VALVE ARRANGEMENT

[76] Inventor: Thomas H. Smith, 17 Oakcrest Dr., Laurel, Miss. 39440

[21] Appl. No.: 832,821

[22] Filed: Sep. 13, 1977

[51] Int. Cl.[2] ..... F04B 9/00; F04B 15/02

[52] U.S. Cl. ..... 417/318; 417/519; 417/900; 251/367

[58] Field of Search ..... 417/900, 519, 532, 318; 137/625.22; 251/367; 92/255

[56] References Cited

U.S. PATENT DOCUMENTS

| | | | |
|---|---|---|---|
| 2,032,163 | 2/1936 | Bagby | 417/519 |
| 2,732,858 | 1/1956 | Noon | 251/367 X |
| 3,279,383 | 10/1966 | Smith | 417/900 X |
| 3,295,452 | 1/1967 | Smith | 417/900 X |
| 3,552,440 | 1/1971 | Smith | 137/625.47 |
| 3,994,627 | 11/1976 | Calzolari | 417/900 |

FOREIGN PATENT DOCUMENTS

| | | | |
|---|---|---|---|
| 495956 | 6/1954 | Italy | 251/367 |

*Primary Examiner*—Carlton R. Croyle
*Assistant Examiner*—Richard E. Gluck
*Attorney, Agent, or Firm*—Shoemaker and Mattare, Ltd.

[57] ABSTRACT

A pump and valve arrangement includes a three-way valve at the juncture of an inlet line, an outlet line and a pumping chamber. The valve comprises a generally spherically shaped flow control member rotatable in a valve body and having an arcuate slotted passage in one side thereof adapted to communicate simultaneously with either the inlet line and pumping chamber or the outlet line and pumping chamber for alternate flow of material from the inlet line into the pumping chamber and then from the pumping chamber through the outlet line. Adjustable seat sleeves extend into the body into sealing engagement with the flow control member and a journal of the flow control member extends outwardly of the valve body and has a quick release crank attachment thereon. The pump and valve are operated in synchronism with one another by respective motors controlled from position responsive switches. The structure of the valve enables easy cleaning and servicing thereof and valve cycle times and wear on the valve are less than with prior art structures.

7 Claims, 9 Drawing Figures

PUMP AND VALVE ARRANGEMENT

BACKGROUND OF THE INVENTION

This invention relates to a pump and valve arrangement for controlling flow of pumpable material, and particularly for controlling flow of slurries of solid materials. For example, the pump and valve combination of the invention has particular utility in pumping byproducts from slaughter houses, such as crushed bones, hooves, skin and other like materials. Additionally, the present invention has particular utility in handling citrus products, such as skins, pith and other waste matter which is, or may be, converted into useful byproducts. The pump and valve arrangement of the invention is normally located at a collecting area for pumping the material to an outside collector some distance away from the collecting area for storage or other process to be formed on the material.

Prior art pump and valve arrangements of the general type referred to above are known in the art, and various arrangements of pumps and valves in combination are used. Applicant's own prior U.S. Pat. No. 3,552,440, discloses a similar pump and valve arrangement used for pumping concrete. However, the particular arrangement and construction of the valve and pump in applicant's prior patent are considerably different from that in the present application. For example, in applicant's prior patent the rotary flow control member has passages extending therethrough at right angles to one another, with transversely extending webs 26 and 48 extending across the slot or flow passage through the rotary member. Thus, when the flow control member is rotated, the webs 26 and 48 must cut through the material, which slows the cycle time for the valve and also increases the wear thereon. Moreover, the crank attachment to the journal of the flow control member in applicant's prior patent is relatively difficult to disassemble for repair or replacement or the like, as compared with the crank attachment in the present application.

With the present invention, the unique construction of the ball valve with its arcuate slot enables a faster cycling operation of the valve with less wear and maintenance thereon. Additionally, when a cycle of operation is completed, the valve can be closed for sealing the system against odor and deterioration of the products. Still further, with the rear opening in the valve of the present invention, easier cleaning and inspection are allowed.

OBJECTS OF THE INVENTION

Therefore, it is an object of this invention to provide a pump and valve combination wherein the valve includes a rotary member connected to be operated in synchronism with a pump for controlling flow of pumpable material, and wherein the valve has an easily detachable crank attachment.

Another object of the invention is to provide a rotary valve and pump combination wherein the valve is arranged with a cleaning opening positioned for easy access to enable quick and easy repair and cleaning of the valve.

Yet another object of the invention is to provide a valve and pump combination wherein the valve is rotatable between plural positions, and in one of said positions the valve closes a system against odor and deterioration of product handled thereby.

DETAILED DESCRIPTION OF THE INVENTION

Figure 1:
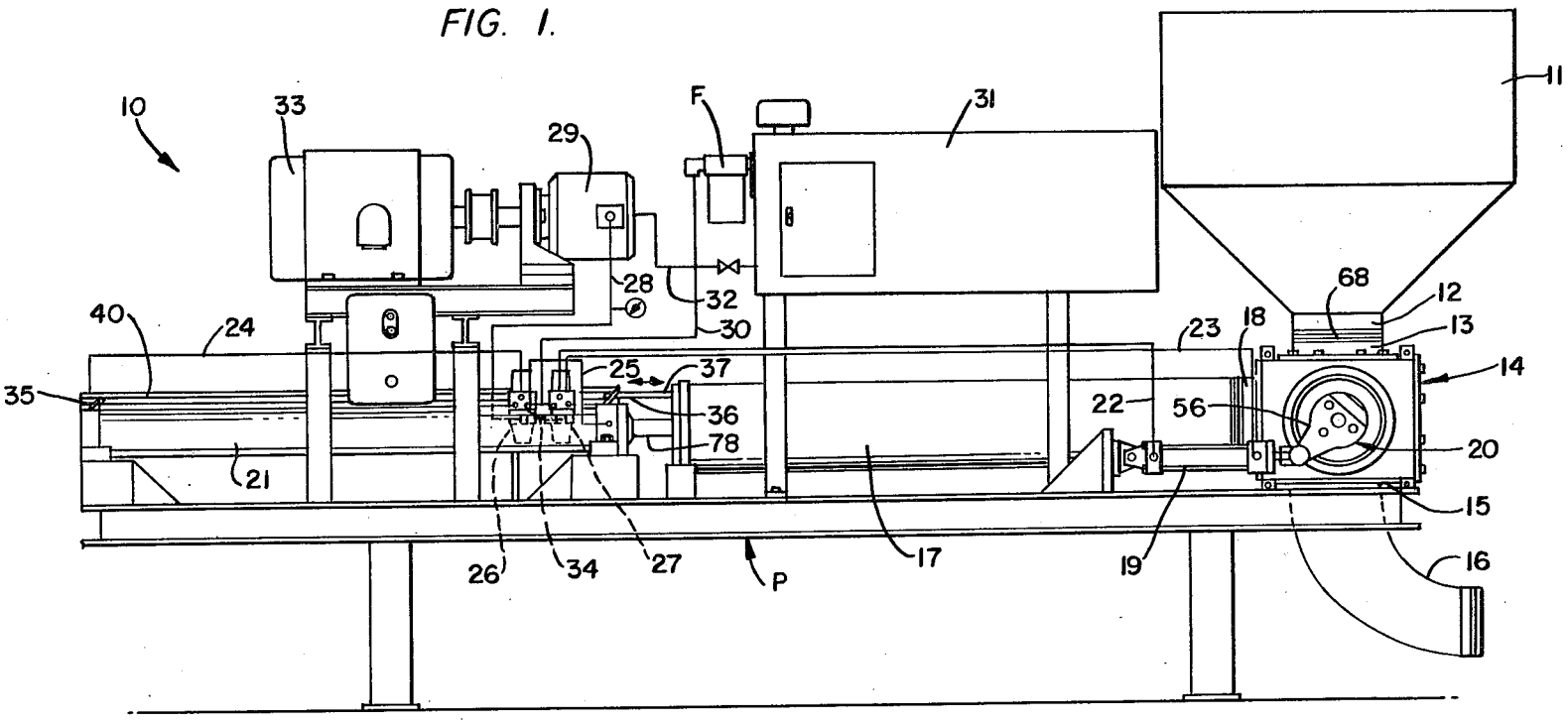
FIG. 1 is a view in elevation of an apparatus embodying the teachings of the present invention.

In the drawings, wherein like reference numerals indicate like parts throughout the several views, an apparatus embodying the teachings of the invention is indicated generally at 10 in FIG. 1 and comprises a hopper 11 or other source of material to be pumped having an outlet 12 extending from the bottom thereof. The outlet 12 is connected with an inlet 13 of a valve 14, which in turn has an outlet 15 connected with an elbow or extension 16 extending to a discharge line (not shown) for conducting or conveying the pumped material to a collection point. The elbow 16 comprises a reduction fitting and tapers from a first diameter at its inlet end to a second, smaller diameter at its outlet end. A pump chamber 17 has one end thereof connected with a fitting 18 on the valve 14 for alternately drawing material from the hopper 11 through the valve and into the pump chamber 17, and for then expelling the material from the pump chamber through the outlet 15 and elbow 16.

A hydraulic or pneumatic or other suitable valve actuator 19, such as a Parker Fluid Power Series 2H motor, is connected with a crank 20 on the valve 14 to operate the valve between its respective positions, and a similar actuating means 21, such as a Parker Fluid Power Series 2H motor, is connected with a piston in piston chamber 17 for operating the piston. The motors 19 and 21 are actuated by fluid pressure through lines 22 and 23 and 24 and 25, respectively. The fluid pressure lines 22, 23, 24 and 25 are connected with respective valves 26 and 27 connected respectively with a pressurized fluid supply line 28 connected with the valve 26 and a pump 29 and a fluid return line 30 connected with the valve 27 and a holding tank 31. Examples of suitable valves are disclosed in U.S. Pat. Nos. 2,586,906, 3,701,366, 3,459,255, 3,200,847 and 3,608,586. The disclosures of these patents are incorporated herein by reference thereto. The tank 31 is connected through a conduit 32 with the pump 29 for circulation of the motor operating fluid through the pump 29 and valves 26 and 27 into motors 19 and 21 and from the motors back through the valves and line 30 to tank 31 and thence through line 32 back to the pump 29. A filter F is preferably connected between line 30 and holding tank 31 for filtering contaminants and the like from the fluid. The pump 29 is connected to be driven from a suitable motor 33. The entire apparatus, including the pump 17, valve 14, hopper 11, holding tank 31, pump 29 and motor 33 and associated components, is supported on a platform or frame P.

The valves 26 and 27 are preferably solenoid operated valves connected in fluid communication with one another through a conduit 34 and operation of the valves is controlled by means of a suitable conventional relay delay circuitry, including microswitches 35 and 36 arranged such that the switch 36 is operated at the end of the forward or pressure stroke of piston 17 to initiate operation of valves 26 and 27 to reposition rotary valve 14 and initiate return movement of the piston 17. Examples of microswitches suitable for use as switches 35 and 36 are disclosed in U.S. Pat. Nos. 3,648,004, 3,493,707, 3,712,965 and 3,832,500, the disclosures of which are herein incorporated by reference thereto. At the end of the return or suction stroke of piston 17, the switch 35 is operated to once again effect operation of valves 26 and 27 to return rotary valve 14 to its initial position and initiate forward movement of the piston 17. Control or operation of microswitches 35 and 36 is effected through a rod 37 connected with the piston in chamber 17 for reciprocation therewith and carrying a pin 38 thereon which projects through a slot 39 in a tube or sleeve 40, whereby reciprocating movement of the piston in chamber 17 causes reciprocating movement of rod 37 and alternate engagement of pin 38 with microswitches 35 and 36. The switches 35 and 36 are coupled or ganged through a connecting link 41, whereby operation of one switch simultaneously effects operation of the other switch, such that repositioning of the rotary valve 14 is accomplished simultaneously with reversing movement of the piston in piston chamber 17.

Figure 5:
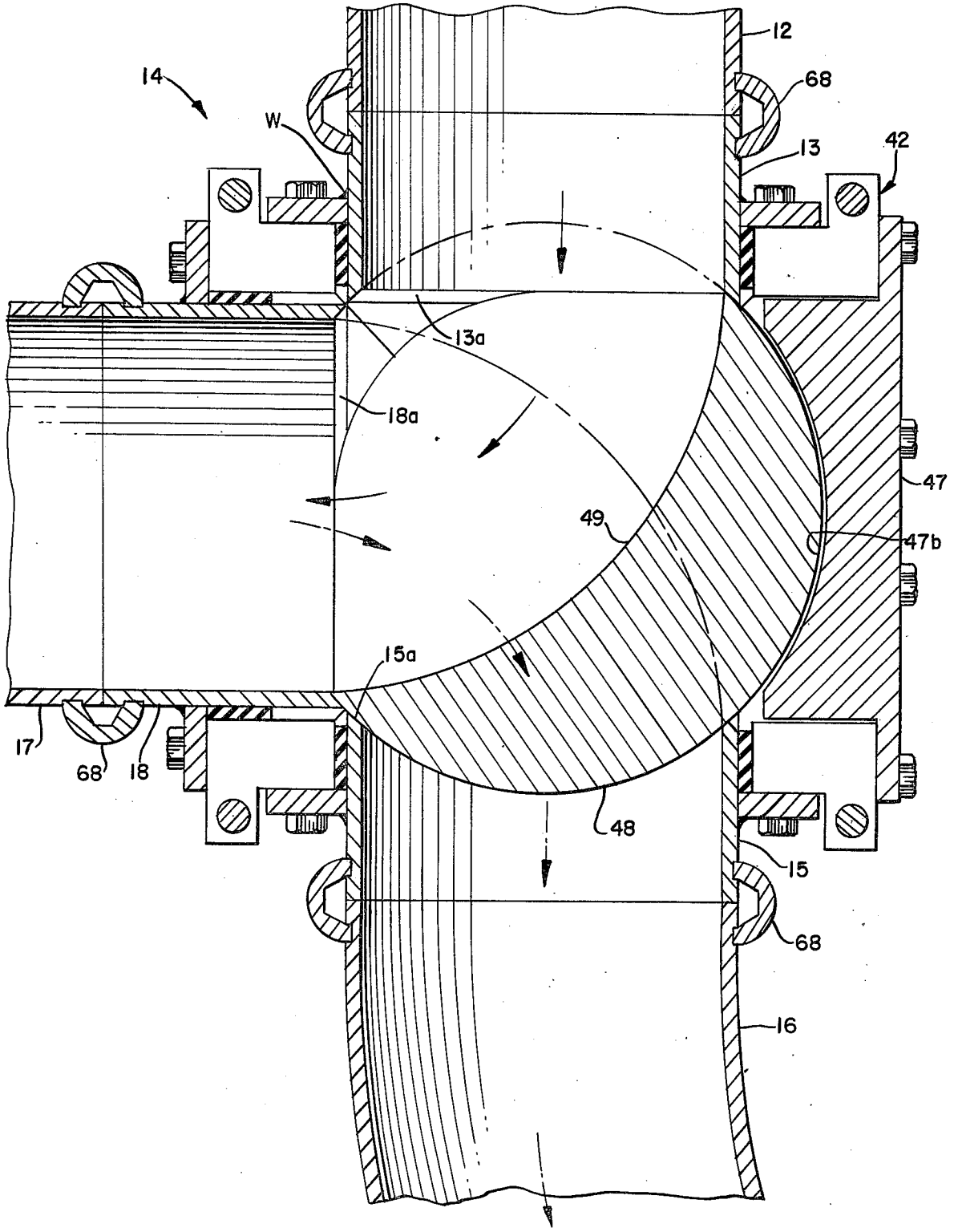
FIG. 5 is an enlarged, fragmentary, sectional view of the valve used in the apparatus of FIG. 1.
Figure 6:
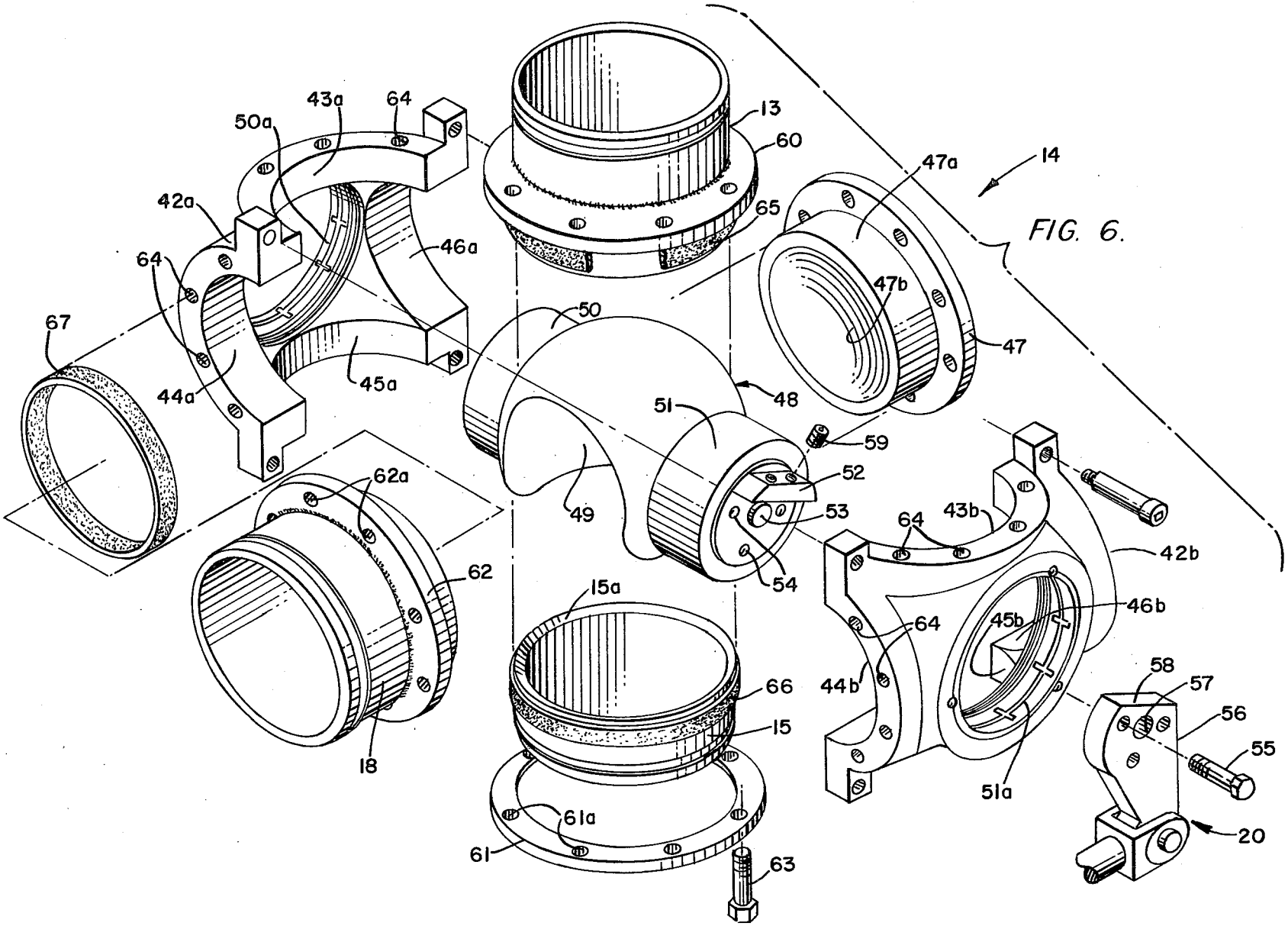
FIG. 6 is an exploded, perspective view of the valve of FIG. 5.

The valve 14 is illustrated in detail in FIGS. 5 and 6, and comprises a split or two-part casing 42 having mating casing halves **42*a* and 42*b* with semicircular cutouts 43*a* and 43*b* for receiving the inlet seat sleeve 13 and semicircular cutouts 44*a* and 44*b*, respectively, for receiving the pump chamber seat sleeve 18. The casing halves also include semicircular cutouts 45*a* and 45*b*, respectively, for receiving the outlet seat sleeve 15 and semicircular cutouts 46*a* and 46*b* for receiving a closure plate 47, on the side of the valve casing axially opposite the pump chamber 17**.

A spherical closure member 48 has an arcuate channel or slot 49 formed therein of a size to form a smooth continuous line extending from one seat sleeve to another seat sleeve for uninterrupted, relatively smooth flow of material through the valve when the valve is positioned in one of its operative positions for flow of material therethrough, as indicated, for example, in full lines and phantom lines in FIG. 5. The ball valve or rotary closure member 48 has journals 50 and 51 projecting from opposite sides thereof and the journal 51 has an axially projecting flange or boss 52 thereon disposed to one side of the center of the journal and an upstanding boss 53 is formed on the axial center line of the journal. A plurality of threaded holes 54 are formed in the end of the journal for receiving stud bolts 55 to secure a crank arm 56 to the journal. The crank arm has an opening 57 formed therethrough adjacent one end thereof in which the boss 53 on the journal is received and a flat end 58 is on said end of the crank for engagement against the flange or boss 52 on the journal to prevent relative turning movement between the crank and journal. The bolts 55, of course, secure the crank to the journal. Set screws or the like 59 are extended through the flange or boss 52 into engagement with the end surface 58 of the crank to make fine adjustments of the angular relationship of the crank and rotary flow control member relative to the valve seats to thus obtain accurate positioning of the valve and control of flow therethrough.

The seat sleeves 13, 15 and 18 extend at their inner ends into the valve casing into engagement with the outer peripheral surface of the ball valve member 48 and the inner ends thereof are thus preferably contoured with a concave configuration to match the surface of the ball to thus obtain close fitting engagement between the seat sleeves and the ball. The contoured end surfaces of the seat sleeves are indicated at **13*a*, 15*a* and 18*a*, respectively. Additionally, the seat sleeves 13, 15 and 18 have annular attaching flanges 60, 61 and 62 secured thereon on the outer surface thereof, as by means of a weld W or the like, and the flanges have a plurality of holes 60*a*, 61*a* and 62*a* formed therethrough for extension of suitable fastening means 63 through the holes in the flanges and into aligned threaded holes 64 in the facing surface portions of valve casing halves 42*a* and 42*b*. Each of the seat sleeves 13, 15 and 18 is sealed relative to the assembled casing halves by means of seal rings 65, 66 and 67, respectively, made of a suitable material, such as rubber or the like. The end closure plate 47 has an inwardly directed central portion or boss 47*a* with a concave recess 47*b* in the end surface thereof for mating cooperation with the external surface of the ball valve 48. The seat sleeves are coupled to the hopper outlet 12, elbow 16 and pump chamber 17 by means of suitable clamps 68** of a conventional and well-known type.

Additionally, the journals 50 and 51 of the rotary valve member 48 are extended through openings **50*a* and 51*a*, respectively, in the valve casing portions 42*a* and 42*b*** and are sealed relative to the openings by means of suitable conventional sealing structure, such as quad rings or the like.

Figure 7:
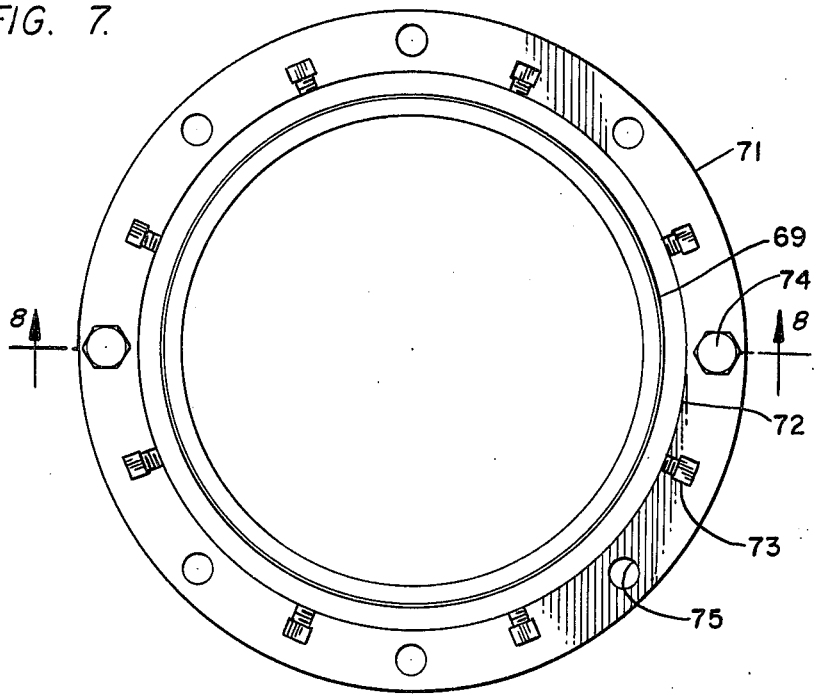
FIG. 7 is a plan view of a seat sleeve and attaching ring structure for a modification of the valve of the invention, wherein the seat sleeve is adjustably mounted by means of adjustment bolts.
Figure 8:
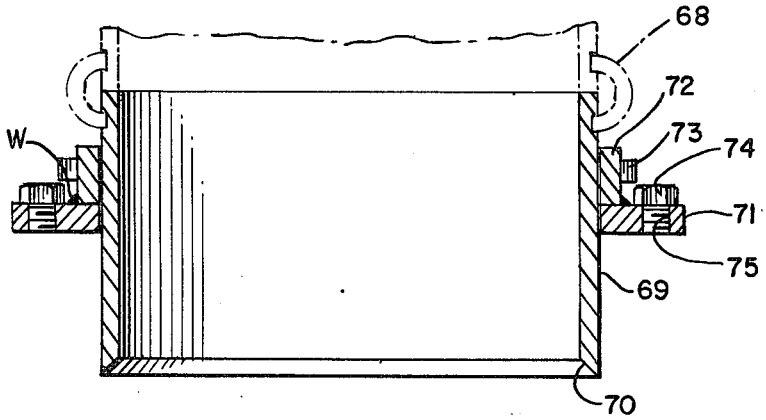
FIG. 8 is a view in section taken along line 8—8 in FIG. 7.
Figure 9:
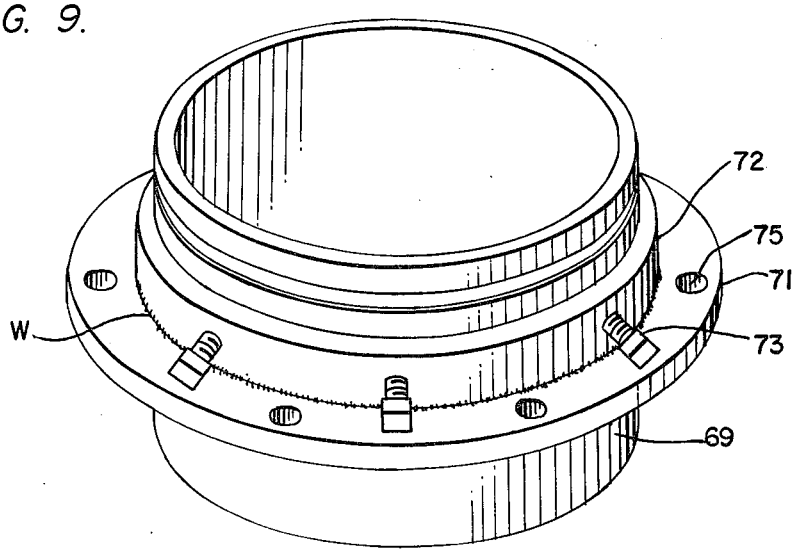
FIG. 9 is a perspective view of the adjustable seat sleeve construction of FIGS. 7 and 8.

A modified seat sleeve arrangement is illustrated in FIGS. 7, 8 and 9 and in this form of the invention the seat sleeve 69 also has a contoured, concave end surface 70 for cooperation with the rotary valve member, as in the previously described form of the invention. However, rather than the attaching flange being welded to the outer surface of the seat sleeve, as in the previous form of the invention, the attaching flange 71 has an upstanding annular ring-shaped clamping collar 72 welded or otherwise suitably affixed through the upper surface thereof, with the inner surface of the clamping collar 72 substantially coplanar with the opening through the attaching flange 71. A plurality of set screws or the like 73 are extended through the clamping collar 72 into engagement with the outer surface of the seat sleeve 69 to securely clamp the attaching flange 71 in an axially adjusted position along the length of the seat sleeve 69. Bolts 74 or the like are then extended through the openings 75 in the attaching flange 71 into the aligned openings in the valve casing to secure the seat sleeve in position relative to the casing.

A piston 76 is reciprocable in the piston chamber or cylinder 17 and comprises a backplate 77 suitably secured to the forward end of a piston rod 78 which extends rearwardly through the piston chamber 17 to the motor 21 for operation of the piston 76. The backplate 77 has a forwardly projecting boss 79 thereon internally threaded at 80 for mating cooperation with threads 81 on the forward end of piston rod 78 and a set screw or locking pin or the like 82 extends radially through the projection 79 into engagement with the forward threaded end 81 of piston rod 78 to securely retain the backplate 77 in position on the rod.

Figure 4:
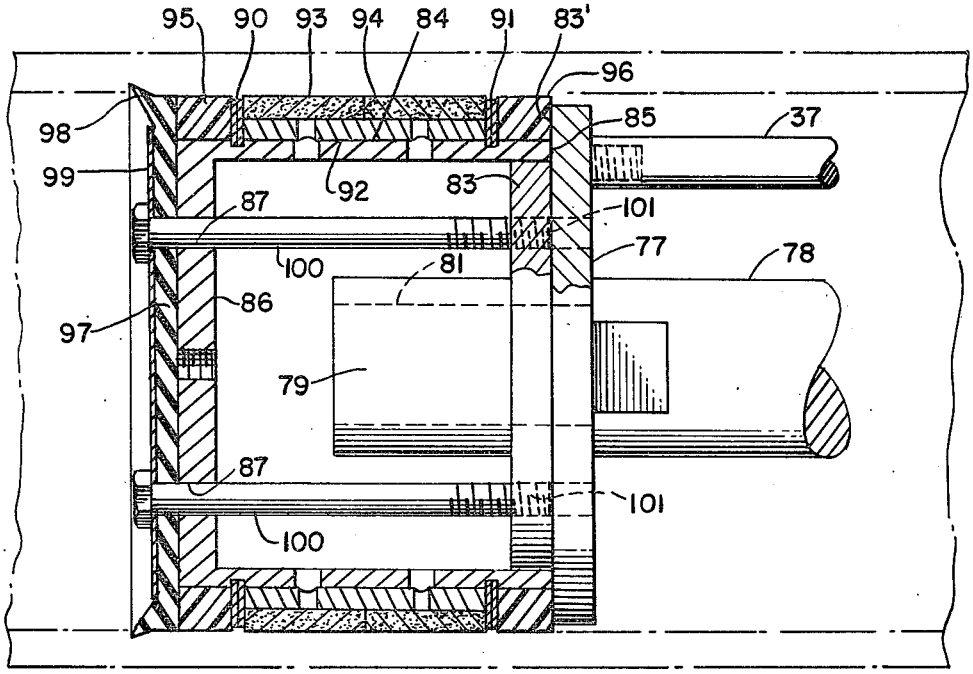
FIG. 4 is a view in section of the pump of FIG. 3.

The plate also includes a reduced diameter portion 83 which defines a forwardly facing shoulder 83' at the periphery thereof and a substantially cup-shaped sleeve member or piston body 84 has the open end 85 thereof received over the reduced diameter portion 83 in abutting engagement with shoulder 83' at the periphery of plate 77. The cup-shaped body has a closed forward end 86 with a plurality of openings 87 extending axially therethrough. The outer circumference of body 84 has a pair of spaced channels 88 and 89 therein in which snap rings 90 and 91 are respectively received. A spacer sleeve 92 closely surrounds the piston body 84 and extends between the snap rings 90 and 91 and a pair of abutting oiler rings 93 and 94 of a suitable material such as felt or the like surround the spacer sleeve 92 and are substantially coextensive therewith and extend between the snap rings 90 and 91. A pair of guide rings 95 and 96 are positioned around the body axially outwardly of the snap rings 90 and 91, and as seen in FIG. 4, the diameters of the guide rings 95 and 96 and of the oiler rings 93 and 94 are slightly greater than the diameter of the backplate 77.

A disc-shaped sealing element 97 having a flexible peripheral lip 98 thereon is secured on the forward end of piston body 84 by means of a rigid plate 99 and a plurality of elongate bolts 100 extended through the plate 99 and disc 97 and through aligned openings 87 in end wall 86 of body 84, and thence rearwardly through the interior of the piston into threaded openings 101 in the backplate 77.

Figure 2:
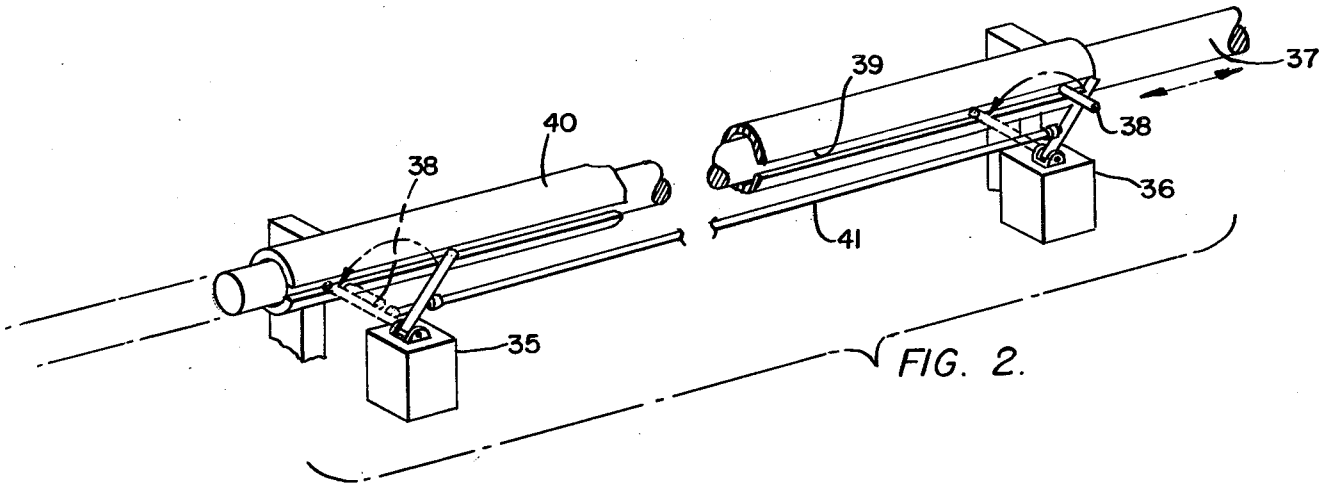
FIG. 2 is a fragmentary, perspective view shown greatly enlarged of a portion of the switch control means of the apparatus of FIG. 1.
Figure 3:
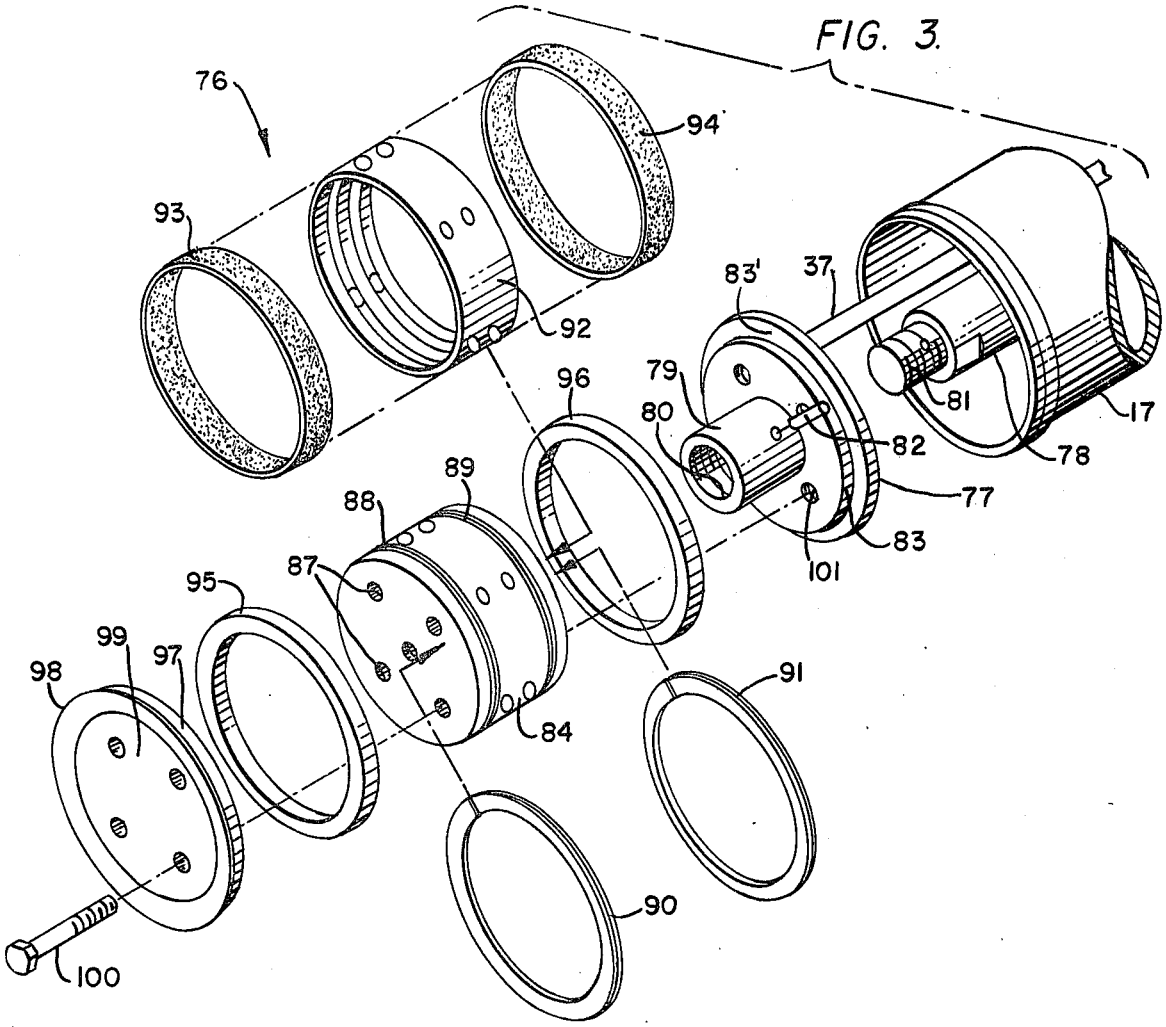
FIG. 3 is an enlarged, exploded, perspective view of the piston used in the pump of the invention.

In operation, a material to be pumped is placed in the hopper 11 with the valve 14 in closed position, as indicated in phantom lines in FIG. 5, and with the piston 76 in its rearmost position in cylinder 17. Energization of motor 33 causes operation of pump 29 to supply pressure fluid to the valves 26 and 27, which are positioned to supply pressure behind the motor 21 to drive piston 76 forward in cylinder 17, and at the same time the valve 14 is in the position shown in phantom lines in FIG. 5. At the forward end of the stroke of piston 76 the microswitch 36 is engaged by pin 38 carried on rod 37, reversing or changing the position of valve 26 to reverse the direction of operation of motor 21 and thus cause the piston 76 to move rearwardly in chamber 17. Simultaneously, the switch 35 is operated to a corresponding position, changing the operative condition of valve 27 and supplying pressure fluid to the motor 19 to reverse its direction and pivot the valve closure member 48 to the position shown in full lines in FIG. 5. Thus, rearward movement of the piston 76 through piston chamber 17 draws material from the hopper into the piston chamber and when the piston reaches its rearmost position, the switch 35 is engaged by pin 38 to operate the switch 35 to the position shown in phantom lines in FIG. 2 to again change the states of valves 26 and 27 and reverse operation of the motors 19 and 21 to once again move the valve closure 48 to the position shown in phantom line in FIG. 5 and to cause forward motion of the piston 76 to expel the material through the valve and through elbow 16.

A delay relay control system is used to control operation of the piston and valve 14 such that the proper operating sequence is obtained to avoid strain or breakage of components.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A pump and valve combination, comprising: a source of material to be pumped; a rotary valve means having an inlet connected with said source and an outlet connected with an outlet conduit extending to a remote location, said inlet and outlet axially aligned with one another on top and bottom sides, respectively, of said valve means; a reciprocating pump means connected with said valve means at one side thereof, between the inlet and outlet; said valve means having a cleaning opening in the other side thereof opposite said pump; a removable closure closing said cleaning opening; said valve means including a housing with a rotatable closure member therein, said closure member having a journal extended through one side of the housing, a removable crank on said journal; said valve housing comprising two substantially identical parts releasably secured together, each of said parts having cutouts therein which mate with corresponding cutouts in the other part to define openings, seat sleeves extended from exteriorly of the housing through the openings into engagement with the closure member, seal means sealing the seat sleeves relative to the housing, and means releasably securing the seat sleeves to the housing; valve motor means connected with the crank for rotating the closure member between a first position establishing communication between the source and the pump, and a second position rotated 90 degrees from the first position establishing communication between the pump and the outlet; pump motor means connected with the pump to reciprocate the pump to alternately draw material from the source, through the valve means and into the pump and to then expel the material from the pump, through the valve means and to the remote location; and control means connected with each said motor means to operate the motor means in synchronism to obtain desired control over flow of the material.

2. The combination as in claim 1, wherein said cutouts are semicircular, said openings are circular and said seat sleeves are cylindrical.

3. The combination as in claim 1, wherein there are three seat sleeves, one each connected with the source of material, the outlet conduit and the pump means.

4. The combination as in claim 1, wherein the pump means includes a reciprocating piston, a piston rod connected with the piston and extending axially therefrom, said pump motor means comprising a fluid motor connected with the piston rod to reciprocate the piston rod and piston, and a control rod connected to the piston and extending therefrom parallel to the piston rod, said control means including spaced microswitches, and projecting means on the control rod engageable with the microswitches at opposite limits of travel of the piston, to initiate reverse movement of the piston and operation of the valve means to another position.

5. The combination as in claim 1, wherein the seat sleeves are releasably, axially, adjustably clamped in a clamp ring, and a flange is on the clamp ring for securing the ring and thus the seat sleeve to the valve housing.

6. The combination as in claim 1, wherein the journal on the closure member has an axially projecting flange thereon offset to one side of the axis of the journal, the crank having an end in mating engagement with the flange to prevent relative rotation between the crank and journal, and fastening means releasably holding the crank to the journal.

7. The combination as in claim 1, wherein the pump means comprises a piston reciprocable in a cylinder, said piston comprising a disc-shaped back plate having a central opening therein, a piston rod secured at a forward end thereof in the opening in the back plate, a cup-shaped piston body having a closed end and an open end and engaged at its open end on the back plate, guide ring means on the piston body extending circumferentially thereof for sliding engagement with the cylinder, piston seal means secured on the closed end of the piston body and having a flexible peripheral sealing lip in sealing, sliding engagement with the cylinder, and fastening means extended through the piston body into the back plate to hold the piston in assembled relation.

* * * * *